US007885735B2

(12) United States Patent
Katzer

(10) Patent No.: US 7,885,735 B2
(45) Date of Patent: Feb. 8, 2011

(54) MODEL TRAIN CONTROL

(76) Inventor: Matthew A. Katzer, 1416 NW. Benfield Dr., Portland, OR (US) 97229

( * ) Notice: Subject to any disclaimer, the term of this patent is extended or adjusted under 35 U.S.C. 154(b) by 0 days.

(21) Appl. No.: 12/658,497

(22) Filed: Feb. 10, 2010

(65) Prior Publication Data

US 2010/0145557 A1 Jun. 10, 2010

Related U.S. Application Data

(63) Continuation of application No. 11/266,772, filed on Nov. 2, 2005, now abandoned.

(60) Provisional application No. 60/626,683, filed on Nov. 10, 2004, provisional application No. 60/628,765, filed on Nov. 16, 2004, provisional application No. 60/634,884, filed on Dec. 8, 2004.

(51) Int. Cl.
*A63H 19/24* (2006.01)

(52) U.S. Cl. ..... 701/19; 105/1.5

(58) Field of Classification Search ..... 701/19–20; 105/1.5

See application file for complete search history.

(56) References Cited

U.S. PATENT DOCUMENTS 5,448,142 A * 9/1995 Severson et al. ..... 318/280
5,456,604 A * 10/1995 Olmsted et al. ..... 434/62
5,896,017 A * 4/1999 Severson et al. ..... 312/280
5,901,329 A * 5/1999 Kito ..... 710/8
6,220,552 B1 * 4/2001 Ireland ..... 246/122 R
6,270,040 B1 * 8/2001 Katzer ..... 246/1 R
6,457,681 B1 * 10/2002 Wolf et al. ..... 246/187 A
6,494,408 B2 * 12/2002 Katzer ..... 246/1 R
6,533,223 B1 * 3/2003 Ireland ..... 246/122 A
6,539,292 B1 * 3/2003 Ames, Jr. ..... 701/19
6,557,765 B1 * 5/2003 Kito ..... 235/462.3
6,604,641 B2 * 8/2003 Wolf et al. ..... 213/75 TC
6,619,594 B2 * 9/2003 Wolf et al. ..... 246/187 A
6,655,640 B2 * 12/2003 Wolf et al. ..... 246/167 R
6,729,584 B2 * 5/2004 Ireland ..... 246/122 A
7,210,656 B2 * 5/2007 Wolf et al ..... 246/4
7,215,092 B2 * 5/2007 Grubba et al. ..... 318/268
2001/0005001 A1 * 6/2001 Ireland ..... 246/122 A
2002/0113171 A1 * 8/2002 Katzer ..... 246/124
2003/0015626 A1 * 1/2003 Wolf et al. ..... 246/187 A
2003/0127570 A1 * 7/2003 Ireland ..... 246/122 A
2004/0079841 A1 * 4/2004 Wolf et al. ..... 246/167 R
2004/0203843 A1 * 10/2004 Najafi ..... 455/456.1
2004/0239268 A1 * 12/2004 Grubba et al. ..... 318/268
2006/0226298 A1 * 10/2006 Pierson ..... 246/1 R
2006/0256593 A1 * 11/2006 Pierson ..... 363/71

OTHER PUBLICATIONS

Armstrong, John; All About Signals, reprint of articles from 'Trains, *the* magazine of railroading'; Jun./Jul. 1957; 28 pgs; Kalmbach Publishing Co.

Part 1/5: Armstrong, John H.; 'The Railroad/What It Is, What It Does/The Introduction to Railroading'; © 1977; pp. *i*-27; 4th Edition, Simmons-Boardman Books, Inc.

(Continued)

*Primary Examiner*—Thomas G Black
*Assistant Examiner*—Shelley Chen
(74) *Attorney, Agent, or Firm*—Chernoff, Vilhauer, McClung & Stenzel

(57) ABSTRACT

A wireless DCC model railroad throttle comprises a throttle program operable on a portable data processing device to display a graphical user interface and communicate a user's control inputs to a layout controlling interface managing communication with a digitally controlled model railroad layout.

4 Claims, 16 Drawing Sheets

OTHER PUBLICATIONS

Part 2/5: Armstrong, John H.; 'The Railroad/What It Is, What It Does/The Introduction to Railroading'; © 1977; pp. 28-87; 4th Edition, Simmons-Boardman Books, Inc.
Part 3/5: Armstrong, John H.; 'The Railroad/What It Is, What It Does/The Introduction to Railroading'; © 1977; pp. 88-151; 4th Edition, Simmons-Boardman Books, Inc.
Part 4/5: Armstrong, John H.; 'The Railroad/What It Is, What It Does/The Introduction to Railroading'; © 1977; pp. 152-211; 4th Edition, Simmons-Boardman Books, Inc.
Part 5/5: Armstrong, John H.; 'The Railroad/What It Is, What It Does/The Introduction to Railroading'; © 1977; pp. 212-323; 4th Edition, Simmons-Boardman Books, Inc.

* cited by examiner

600

```
>>>>> Revd at 21:34:45
<KAM_XML>
  <portconnect>
     <appid>lococe</appid>
     <port>1</port>
  </portconnect>
</KAM_XML>
>>>>> End - Revd at 21:34:45
```

602

610

```
<<<<< Sent at 21:34:45
<KAM_XML>
  <portconnect>
.....<appid>12345678<appid>
     <port>1</port>
     <language>english</language>
     <pcport>COM1</pcport>
     <connect>1</connect>
     <station>1</station>
     <power>1</power>
     <name>KAM:Simulation</name>
     <security>9999-9999-9999-9999</security>
     <installdate>04-20-2004</installdate>
     <betadate>12-31-1969</betadate>
     <decoderver>80</decoderver>
     <cmdstnver>80</cmdstnver>
     <maxdecoders>48</maxdecoders>
     <xmlvers>29</xmlvers>
  </portconnect>
</KAM_XML>
<<<<< End - Sent at 21:34:45
```

612

FIG. 14

630

```
>>>>> Revd at 08:10:24
<KAM_XML>
  <loadedobject>
      <port>1</port>
      <class>eng</class>
  </loadedobject>
</KAM_XML>
>>>>> End - Revd at 08:10:24
```

640

```
<<<<< Sent at 08:10:24
<KAM_XML>
  <loadedobject>
      <port>1</port>
      <class>eng</class>
      <addresses>1,3,65,1293</addresses>
      <linearaddresses>-1,-1,-1,-1</linearaddresses>
  </loadedobject>
</KAM_XML>
>>>>> End - Sent at 08:10:24
```

FIG. 15

450

```
>>>>> Revd at 23:20:42
<KAM_XML>
 <loco>
    <port>1</port>                 452
    <address>3</address>           454
    <forward>1</forward>           458
    <speed>10</speed>
 </loco>
</KAM_XML>
>>>>> End - Revd at 23:20:42
```

460

```
<<<<< Sent at 23:20:42
<KAM_XML>
 <loco>
    <port>1</port>
    <address>3</address>
 </loco>
</KAM_XML>
>>>>> End - Sent at 23:20:42
```

480

```
>>>>> Sent at 23:20:42
<KAM_XML>
 <locofeedback>
    <port>1</port>
    <address>3</address>
    <forward>1</forward>
    <speed>10</speed>
    <allfunc>0</allfunc>
    <status>0</status>
 </locofeedback>
</KAM_XML>
>>>>> End - Sent at 23:20:42
```

FIG. 16

MODEL TRAIN CONTROL

CROSS-REFERENCE TO RELATED APPLICATIONS

The present application is a continuation of U.S. patent application Ser. No. 11/266,772, filed Nov. 2, 2005 now abandoned, which claims the benefit of U.S. Provisional App. No. 60/626,683, filed Nov. 10, 2004, U.S. Provisional App. No. 60/628,765, filed Nov. 16, 2004, and U.S. Provisional App. No. 60/634,884, filed Dec. 8, 2004.

STATEMENT REGARDING FEDERALLY SPONSORED RESEARCH OR DEVELOPMENT

Not applicable.

BACKGROUND OF THE INVENTION

The present invention relates to a system for controlling model trains.

A primary goal of model train system designers and builders is to make the model train experience as realistic and as satisfying as possible for the user. To enhance the user's experience, model train layouts commonly include elaborate scale scenery, several tracks, and multiple trains. The features and functions of a model train layout, such as track switches or turnouts, signals, and locomotives, are commonly remotely actuated by electrical transducers. For example, the typical model train locomotive includes an electric motor that is energized by power that is conducted to the motor through the tracks and the locomotive's wheels from a power source. The locomotive's speed and direction can be controlled by varying the amplitude and polarity of the voltage applied to the track. This method of train control, now often referred to as the "legacy" mode, has been replaced, in substantial part, by a digital system in which a controlled device, such as a locomotive or a turnout, obtains operating power and control signals from a digital signal transmitted over the track. The digital system provides more flexible and realistic layout operation for an enhanced user experience.

Aspects of a digital control system for model train operation, known as Digital Command Control (DCC), are described by standards and recommended practices of the National Model Railroad Association Inc. (NMRA), which are incorporated herein by reference. DCC adds functionality to model locomotives and other controlled devices associated with model trains and model train layouts, such as lights and turnouts. Referring to FIG. 1, in a DCC model train system 20, each controlled device, such as a locomotive 22 or a turnout 24, includes an individually addressable decoder 26, 28 that responds to receipt of digital data, addressed to the particular decoder, by outputting an appropriate signal to control operation of a motor 30 or other transducer 32 actuating the controlled device. In response to an input at a user interface, a digital command station (DCS) 34 generates a decoder command in the form of a data packet, a set of encoded digital bits, which includes a digital instruction corresponding to the input and the address of the decoder of the particular controlled device that is to respond to the digital instruction. The digital command station 34 is connected by a control bus 36 to a booster 38. The booster 38, which is also connected to a power source 40, amplifies the voltage of the digital signals generated by the digital command station 34 and outputs a higher voltage digital signal to the track 40 or a substantially parallel, accessory bus. As a result, the controlled devices making up the layout and conductively connected to the track or the accessory bus can obtain both control signals and power from the, respective, track or accessory bus.

The user controls the train and other controlled devices of the layout by inputting commands to the DCC system through a user interface known as a "cab" or a "throttle." The throttle is typically a handheld or a desk top unit that includes user operable controls for varying the speed and direction of a locomotive. In addition to the speed and direction controls, a throttle commonly includes a number of switches for controlling other features or functions of the train or the layout. For example a user controlled switch on the throttle may control the train's horn or interior lights. DCC throttles may also include selection controls permitting the user to select at least one of a plurality of locomotives in the layout that is to be operated by the throttle and may include a display to indicate the current settings of the operable controls of the throttle. A throttle 42 may be connected to the digital control system by a cab bus 44 that may include a number of plugs 46 permitting the throttle to be moved around the layout to enhance the user's experience when operating the layout or a portion of the layout. For even greater freedom of movement, a throttle 48 may be wirelessly connected to the digital command control system, typically, by infrared or radio communication.

To enable multiple users to control multiple trains and accessories in a layout, throttles may be connected to the digital command station 34 through a personal computer 50 that includes software that provides an interface to manage the signal traffic between several throttles and one or more digital command stations included in the layout. The present inventor has disclosed a system for controlling a model railroad in U.S. Pat. No. 6,270,040 B1 which is incorporated herein by reference. The model train control system comprises an layout controlling interface between one or more client programs and the digital command station(s) of a DCC layout. The client programs may include a throttle providing a user interface enabling user inputs to operate the layout. The client program outputs a request that is transported to the layout controlling interface by a communications transport. The layout controlling interface places the requests in the order in which they are received from the client program(s) and passes the requests to a digital command station which executes the requests by generating the corresponding DCC data packets for transmission to the controlled devices included in the layout. When a request is received, the layout controlling interface acknowledges the request to the client program releasing the communications transport for further transmissions. After execution, the digital command station passes an acknowledgement back to the layout controlling interface and the interface generates an additional asynchronous response to the client program to indicate that the digital command station has executed the user input. The response of the layout controlling interface to a user input reduces the time interval between a user input and an acknowledgement of the input at the user interface, enabling higher speed communication between the user and the control system and increasing user satisfaction with the operating experience without incurring the cost of a high bandwidth communication channel between the user interface and the digital command station.

While the layout controlling interface between the digital command station and the client program permits a plurality of users to share in operating a model train layout, the user experience is, in substantial part, the result of the user's satisfaction with the user interface that communicates the user's intentions to the DCC system. What is desired, therefore, is a user interface that is easy to set up and operate and provides a satisfying user experience.

BRIEF DESCRIPTION OF THE DRAWINGS

FIG. 14 is an XML coded request and response establishing connection of the throttle and a layout controlling interface for a DCC model railroad layout.

FIG. 15 is an XML coded request and response to update a throttle database following connection of the throttle and a layout controlling interface for a DCC model railroad layout.

FIG. 16 is an XML coded request from the DCC model railroad throttle to establish a locomotive speed and first and second responses from a layout controlling interface for a DCC model railroad layout.

DETAILED DESCRIPTION OF THE INVENTION

Figure 1:
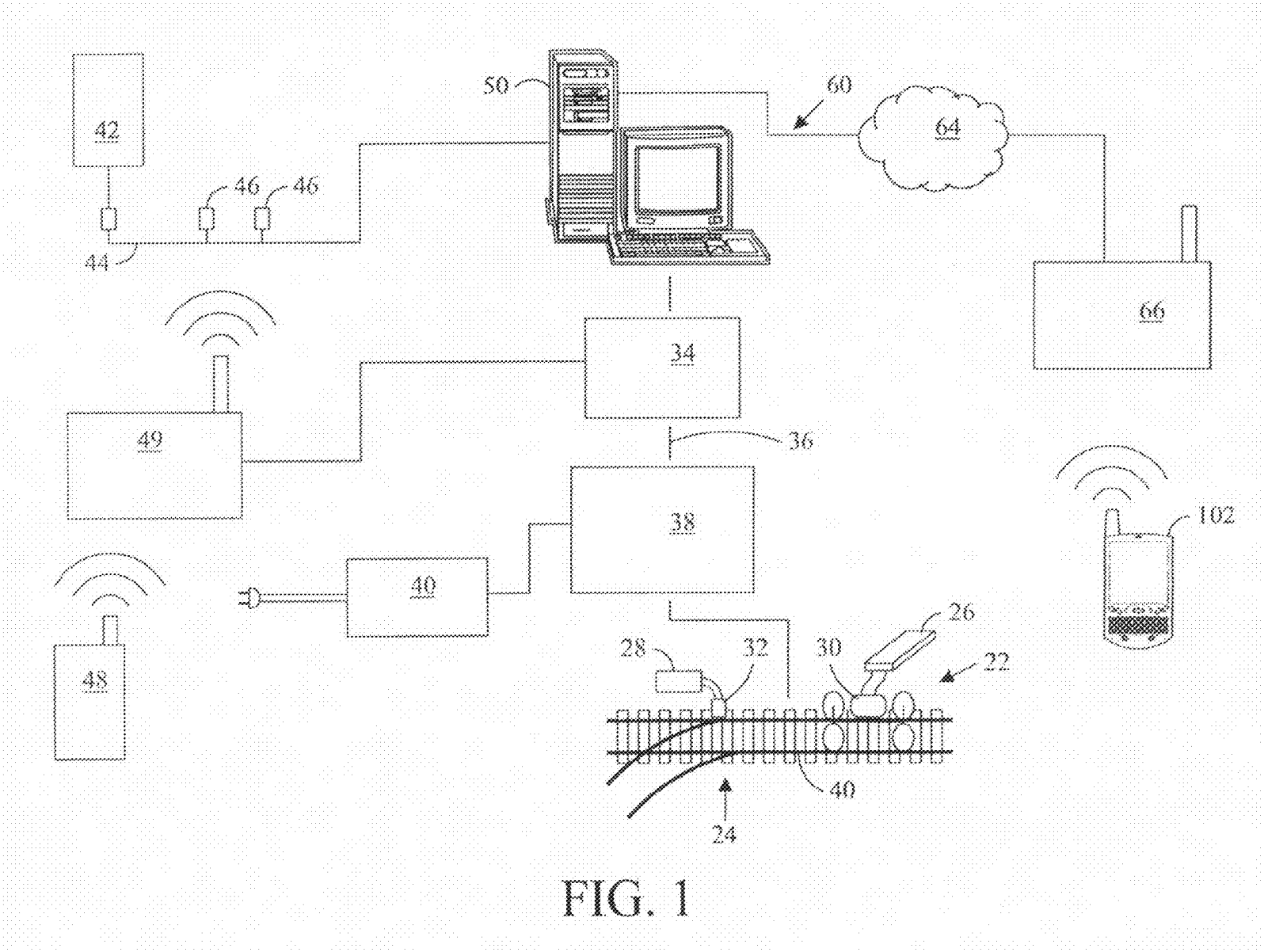
FIG. 1 is a schematic diagram of a model railroad layout including a digital command control (DCC) system.

Referring in detail to the drawings where similar parts of the invention are identified by like reference numerals, and more specifically, to FIG. 1, in a model train layout 20 with a Digital Command Control (DCC) system each controlled device, such as a locomotive 22, a light, or a turnout 24 is connected to an individually addressable digital decoder 26, 28. The decoder 26, 28 responds to a digital data packet that includes the decoder's address by outputting a signal corresponding to a digital instruction contained in the data packet. The instruction causes operation of a motor 30, solenoid, or other transducer 32 actuating the controlled device. If the address included in the data packet is not the address of a particular decoder, the data packet is ignored by that decoder and the actuation state of a device controlled by that decoder is not changed. Aspects of the DCC model train control system are described by standards and recommended practices of the National Model Railroad Association Inc. (NMRA), which are incorporated herein by reference.

The data packets of the DCC model train control are encoded by a digital command station (DCS) 34. The digital command station 34 responds to a control input by the layout's operator(s) or user(s) by encoding the address of a decoder that is to respond to the input and a digital instruction appropriate to cause the controlled device connected to the decoder to operate according to the control input. Generally, there are three types of decoders. Locomotive or engine decoders control the motor and other features, such as the horn or lights, of locomotives. Switch decoders control operation of track turnouts, signaling systems, and crossing gates and sensor decoders are typically read-only devices that report the status of features of the layout, such as track blocks. To provide better equipment utilization and a more realistic user experience, a layout may include several digital command stations 34 respectively assigned to different tasks, such as operating accessories, or portions of the layout. A separate digital command station for accessories, such as switches and sensors, can reduce the volume of signal traffic at the digital command station.

The digital command station 34 is connected to a booster 38 which is also connected to a power source 40. The booster 38 amplifies the voltage of the digital signals generated by the digital command station 34 and transmits the amplified digital signal to the track 40 or, in some cases, a substantially parallel, accessory bus. A separate accessory bus for switches and sensors is sometimes used to reduce the number of connections to the track. Increasing the voltage of the transmitted DCC data packet in the booster enables the locomotives and other devices conductively connected to either the track or the accessory bus to receive both digital control signals and power from, respectively, the track or the accessory bus.

The user operates the locomotive(s) and other controlled devices of a DCC model railroad layout 20 through a user interface known as a "cab" or "throttle." The DCC throttle typically includes a user operable, variable position control enabling the user to input commands to control the speed of at least one locomotive. The DCC throttle also typically includes a plurality switches enabling the user to select particular trains and accessories to be operated by the throttle and to control the direction of the locomotive and the operation of the selected accessories. In addition, the DCC throttle commonly enables the operator to program the decoders included in a layout by setting configuration variables (CVs) that define the address of the decoder and the performance of the device controlled by the decoder. Many throttles also include a display to indicate the current settings for the various user controls of the throttle. The throttle may be a desk top unit but is, commonly, a mobile, hand held unit permitting the user to assume a varying position relative to the layout affording the user a more satisfactory experience when operating a particular portion of the layout. Mobile throttles 42 are commonly connected to the digital control system by a cab bus 44 including a number of plugs 46 permitting the throttle to be moved around the layout to enhance the user's experience. For even greater freedom of movement, a throttle 48 may be wirelessly connected to the digital command control system through an infrared or radio frequency receiver 49.

Figure 2:
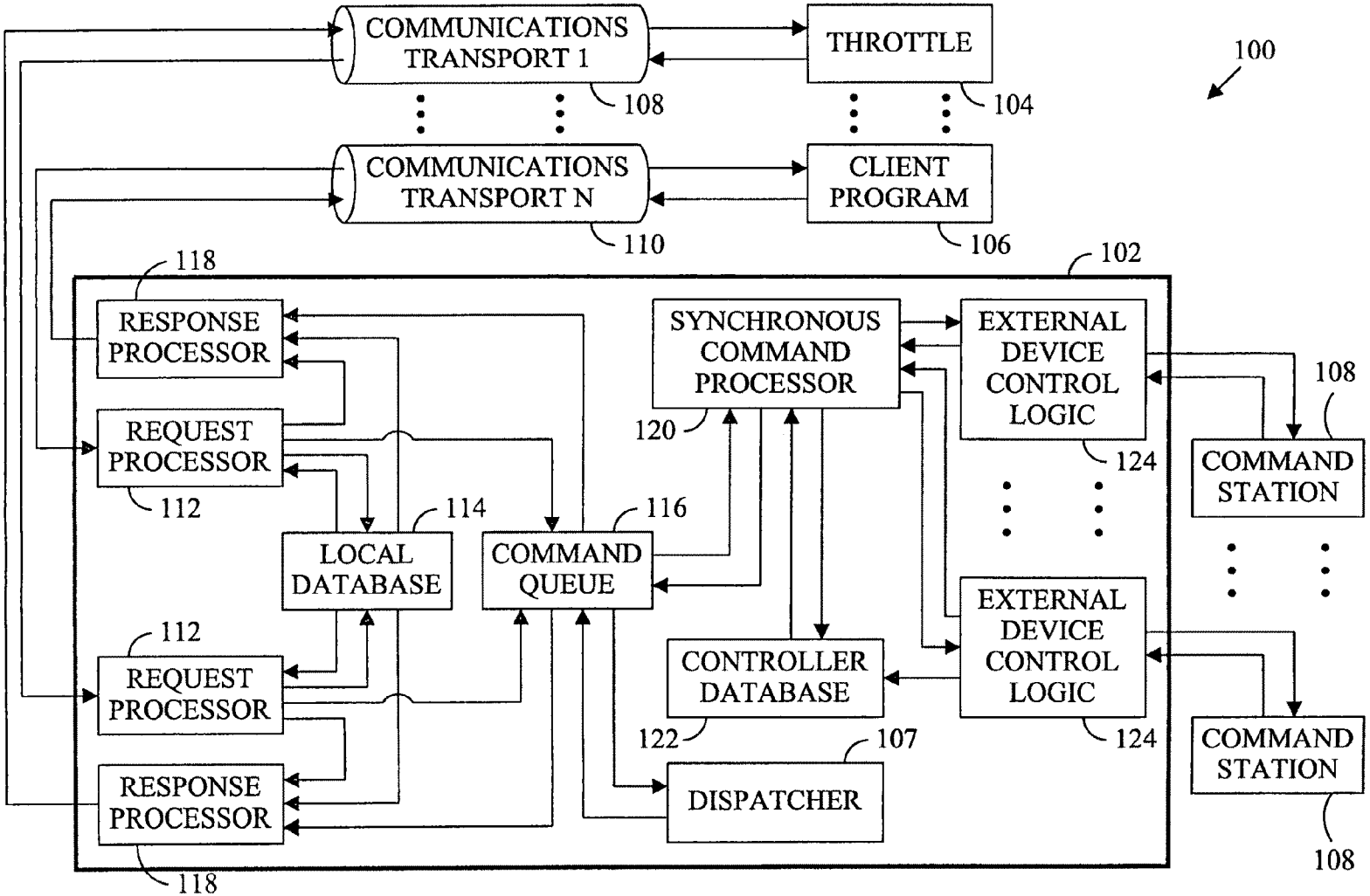
FIG. 2 is a block diagram of a model train control system including a throttle and a layout controlling interface.

Model railroad layouts can be complex with multiple trains and tracks, and a number of accessories and are commonly operable by multiple users. To facilitate operation by one or more operators, the throttles may be arranged to communicate with the layout through a layout controlling interface that manages the signal traffic between the throttle(s) and the digital command station(s). FIG. 2 illustrates a model train control system 100 that includes a layout controlling interface 102 that controls communication between one or more throttles or other layout operating programs and a plurality of digital command stations. The layout controlling interface 102 typically comprises a program installed on a personal computer 50 that is communicatively connected to the throttle(s) and the digital command station(s). An exemplary layout controlling interface for a DCC layout is described in U.S. Pat. No. 6,270,040, which is incorporated herein by reference. This controlling interface for a DCC layout is incorporated in the Train Server® DCC model train interface from KAM Industries, Hillsboro, Oreg. The layout controlling interface 102 receives requests from one or more throttles, such as the throttle 104, or other layout controlling applications, such as a dispatcher application (referred to herein, individually and collectively, as client programs 106); acknowledges the requests; transmits corresponding commands to one or more digital command stations(s) 108 included in the layout, receives responses from the digital command stations(s), and transmits asynchronous responses to the client programs updating the client programs to reflect the current state of a device or the execution of a request.

Communication between one or more client programs 106, including the throttle 104, and the layout controlling interface 102 is enabled by one or more communications transports 108, 110. The communications transports 108, 110, may comprise one or more suitable communication media for the transmission of data, such as a local area network, the internet, a satellite link, or multiple processes operating on a single computer. One preferred communications transport 110 is a COM (common object model) or DCOM (distributed common object model) interface as developed for the Windows operating system from Microsoft Corporation.

A second preferred communications transport 108 utilizes an extensible markup language (XML) data and control schema to provide distributed access to the layout controlling interface 102 over a personal area computer network 60 utilizing the transport control protocol over internet protocol (TCP/IP) protocol stack. The personal area network 60 may comprise a local area network or a wide area network and may include a wireless connection to a client program, such as a throttle 104. The personal area network 60 permits the user to operate the layout from positions adjacent to or even remote from the layout. For example, a video camera may be used to capture an image of the layout that is transmitted to a remote location over the network for display to a operator. User inputs to control the layout can be transmitted from a remotely located throttle to the digital command station(s) of the layout over the network 60 which may include the internet 64.

An infrared link may be used to wirelessly connect a throttle to a DCC layout but requires line of sight between the transmitter and receiver which can be difficult to maintain when the user is concentrating on controlling a locomotive or another portion of the layout. On the other hand, radio frequency (RF) transmission provides an omnidirectional signal that penetrates materials commonly used in layouts, eliminating the line of sight requirement, and making it possible hide access points 66 providing the wireless connection to the network 60. Low cost, convenient, wireless access to data networks can be accomplished with radio frequency devices conforming to a number of standards including the short range Bluetooth and the IEEE 802.11 standards. The IEEE 802.11 standards also provide for infrared communications. These architectures enable data transmission rates that are substantially greater than the transmission rates of the DCC digital command stations and facilities enabling communications conforming to these standards are readily available in portable data processing devices.

Figure 3A:
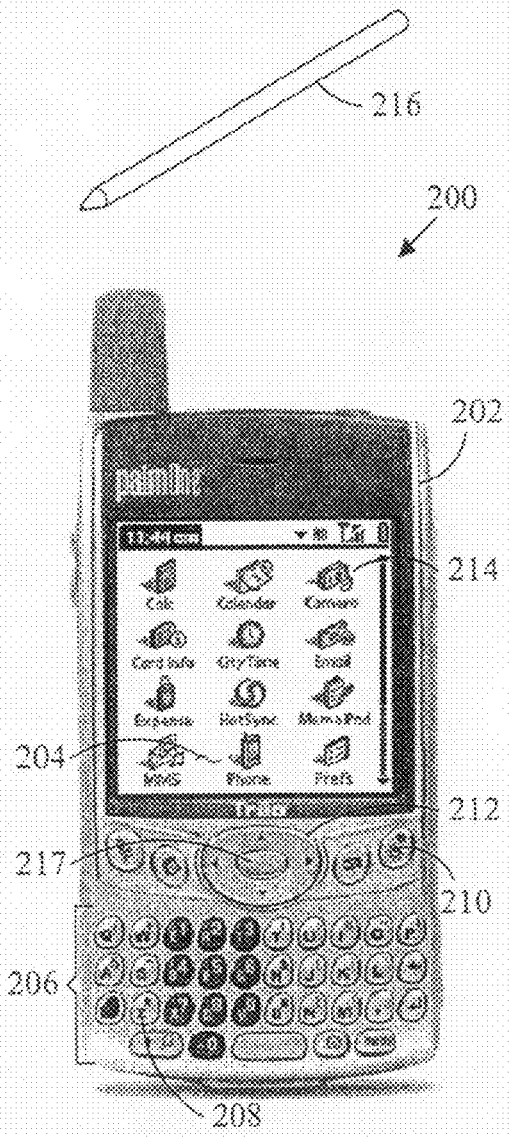
FIG. 3A is a front view of an exemplary portable data processing system.
Figure 3B:
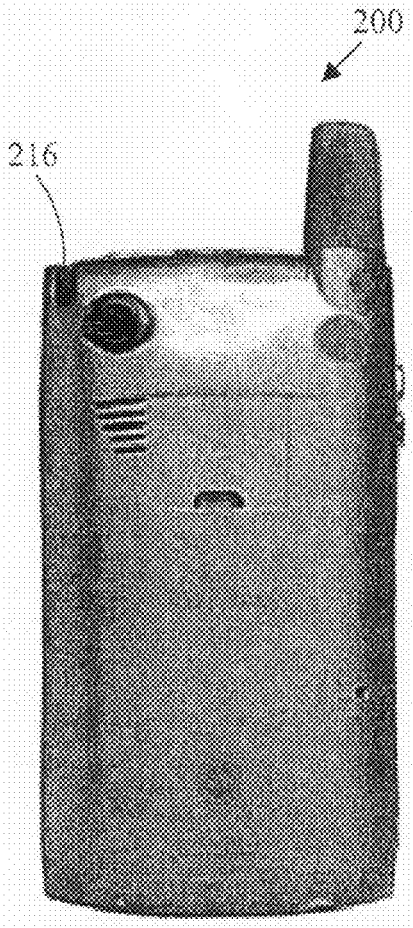
FIG. 3B is a back view of the exemplary portable data processing system of FIG. 3A
Figure 4:
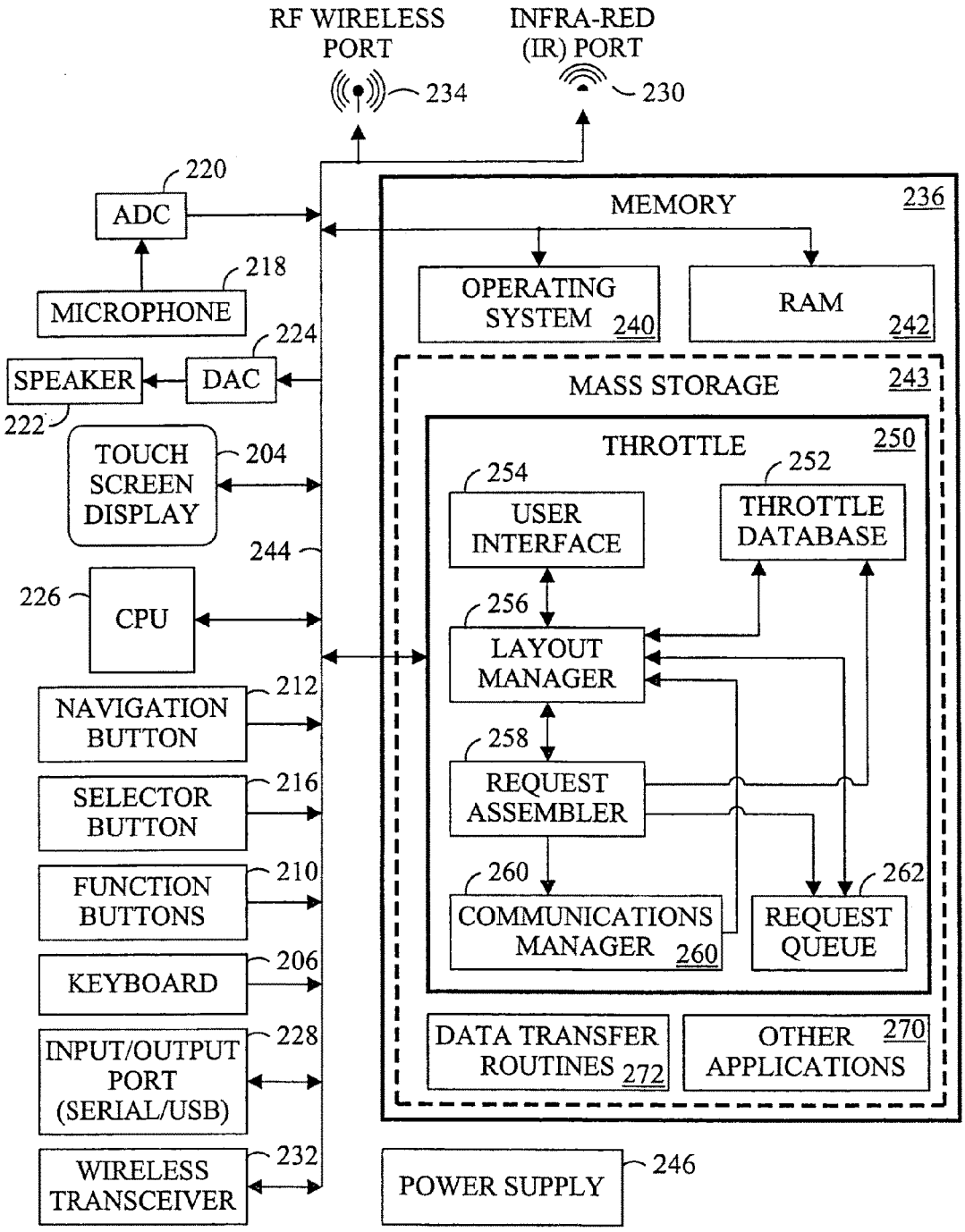
FIG. 4 is a block diagram of a DCC model railroad throttle.

After reflecting on the needs of the operator of a model railroad layout, the present inventor concluded that a throttle comprising a throttle program that is preferably installed in the memory of a portable data processing system such as a personal digital assistant (PDA) equipped for wireless communication with a data processing network could provide a flexible, easily used, portable throttle for the digitally controlled devices of a model railroad layout. Referring to FIGS. 3A, 3B, and 4, an exemplary portable data processing system 200 comprises generally a user interface, a power supply, one or more communications facilities and a data processing apparatus that is typically contained a case 202. The user interface of the portable data processing system typically comprises a color or gray scale display 204 for visually presenting output to the user. Many mobile data processing devices include a liquid crystal display (LCD) in which portions of a layer of dichromatic liquid crystals can be selectively, electro-magnetically switched to block or transmit polarized light. Another type of display comprises organic light emitting diodes (OLED) in which cells comprising a stack of organic layers are sandwiched between a transparent anode and a metallic cathode. When a voltage is asserted between the anode and the cathode of a cell, injected positive and negative charges recombine in an emissive layer to produce light through electro-luminescence. OLED displays are thinner, lighter, faster, cheaper, and require less power than LCD displays. Another emerging display technology for mobile data processing devices is the polymer light emission diode (PLED). PLED displays are created by sandwiching a polymer between two electrodes. The polymer emits light when exposed to a voltage applied to the electrodes. PLEDs enable thin, full-spectrum color displays that are relatively inexpensive compared to other display technologies, such as LCD or OLED, and which require little power to produce a substantial amount of light.

The user interface of the exemplary data processing system 200 also includes one or more user input devices. For example, the exemplary data processing system 200 includes a keyboard 206 (indicated by a bracket) comprising a plurality of user operable keys 208 for inputting text and performing other data processing activities. On the other hand, many portable data processing devices include a detachable external keyboard or a virtual keyboard that is displayed on a touch screen display and actuated by tactile contact with the appropriate virtual keys. In addition, the user interface of the exemplary data processing system 200 includes a plurality of function keys 210. The function keys 210 may facilitate selecting and operating certain features or applications installed on the data processing system, such as a wireless telephone or electronic messaging. The function keys 210 may also be programmable to perform different functions while operating the different applications installed on the device.

The user interface of the exemplary data processing system 200 also includes a navigation button 212 that facilitates movement of a displayed pointer for tasks such as scrolling through and selecting displayed icons 214, menus, lists, and text. In other data processing devices the functions of the navigation button may be performed by a mouse, joy stick, stylus 216, or touch pad. The navigation button 212 includes a selector button 217 permitting displayed objects and text to be selected or activated in a manner analogous to the operation of a mouse button.

Further, the display 204 of the exemplary data processing device comprises a touch screen permitting the user to make inputs to the data processing system by touching the display with a stylus 216 or other tactile device. The user can typically select applications and input commands to the data processing system by touching the screen at points designated by displayed menu entries and icons 214. The exemplary data processing system may also include a handwriting recognition application that converts characters drawn with a tactile device or stylus on the touch screen display 204 to letters or numbers.

The exemplary data processing system 200 may also include a microphone 218 that converts the pressure fluctuations comprising sound, which may include speech, to an analog signal which is converted to digital data by an analog-to-digital converter (ADC) 220. The microphone may be built into the data processing device or may be separate from the case 202 and connected to the data processing system 200 by a wire or through a wireless communication link. Audio output may be provided by a speaker 222. Digital data is converted to an analog signal by a digital-to-analog converter (DAC) 224 and the speaker 222 converts the analog signal to sound. The microphone 218 and speaker 222 provide audio input and output, respectively, when using a wireless telephone and, in conjunction with voice recognition programming can enable verbal commands of a user to control the operation of the data processing device and the installed applications. For example, the user may select various user interfaces of a throttle program by voice command and receive audio feedback of sound effects produced by the layout through use of the microphone and speaker, respectively.

The data processing functions of the exemplary data processing system 200 are performed by a central processing unit (CPU) 226 which is typically a microprocessor. A user can input data and commands to the CPU 226 with the various input devices of the user interface, including the selector button 217, keyboard 206, function buttons 210, and touch screen display 204. The CPU 226 fetches data and instructions from a memory 236 or the user interface, processes the data according to the instructions, and stores or transmits the result. The digital output of the CPU 226 may be used to operate an output device. For example, the digital output may be converted to analog signals by the DAC 224 to enable audio output by the speaker 222. On the other hand, the output of the CPU 226 may be transmitted to another data processing device. Data may be transmitted to a remote data processing device, such as the personal computer 50, via a communications transport comprising a cable connected to an input/output port 228, infra-red light signaling by an infra-red port 230, or radio frequency signaling by a wireless transceiver 232 transmitting and receiving by way of the facilities of a radio frequency (RF) wireless port 234.

Instructions and data used by the CPU 226 are stored in the memory 236. Typically, the operating system 240, the basic operating instructions used by the CPU 226, is stored in a nonvolatile memory, such as read only memory (ROM) or flash memory. Application programs and data used by the CPU are typically stored in a mass storage portion 243 of the memory 236. The mass storage 243 may be built-in to the data processing system 200 and may comprise static random access memory (SRAM), flash memory, or a hard drive. On the other hand, the mass storage 243 may be a form of removable, non-volatile memory, such as flash memory cards; disk storage, such as a floppy disk, compact disk (CD), digital versatile disk (DVD), USB flash drive, or another removable media device. The data and instructions are typically transferred from the mass storage portion 243 of the memory 236 to a random access memory (RAM) 242 portion and fetched from RAM by the CPU 226 for execution. However, in wireless phones and PDAs the mass storage may function as RAM with the data and instructions fetched directly from and stored directly in the mass storage. Data and instructions are typically transferred to and from the CPU 226 over an internal bus 244. A number of application programs; such as a calculator, a calendar, a camera, e-mail, and word processing, collectively referred to as other applications 270, and a number of data transfer routines 272 providing an interface with the various data transfer devices, such as the wireless transceiver 232, are typically stored in the mass storage portion 243 of the memory 236.

The data processing system also includes a power supply 246, which typically includes a battery and regulating circuitry. The battery may be removable for recharging or replacement or the power supply may include recharging circuitry to permit the battery to be recharged in the device. Integrating the recharging circuitry typically permits the data processing system 200 to be powered by an external power source, such as utility supplied, AC power.

The throttle program 250 is typically stored in the mass storage 243 of the portable data processing system 200 and comprises instructions operable to enable a user interface for communicating control inputs through a communications transport 108 between the throttle 104 and a layout controlling interface 102 for a model railroad layout. The throttle program 250 comprises instructions that cause the exhibition of a plurality of graphical user interfaces (GUIs) on the display 204 of the data processing system 200, detect user inputs, and manage communication with the layout controlling interface 102.

Figure 5:
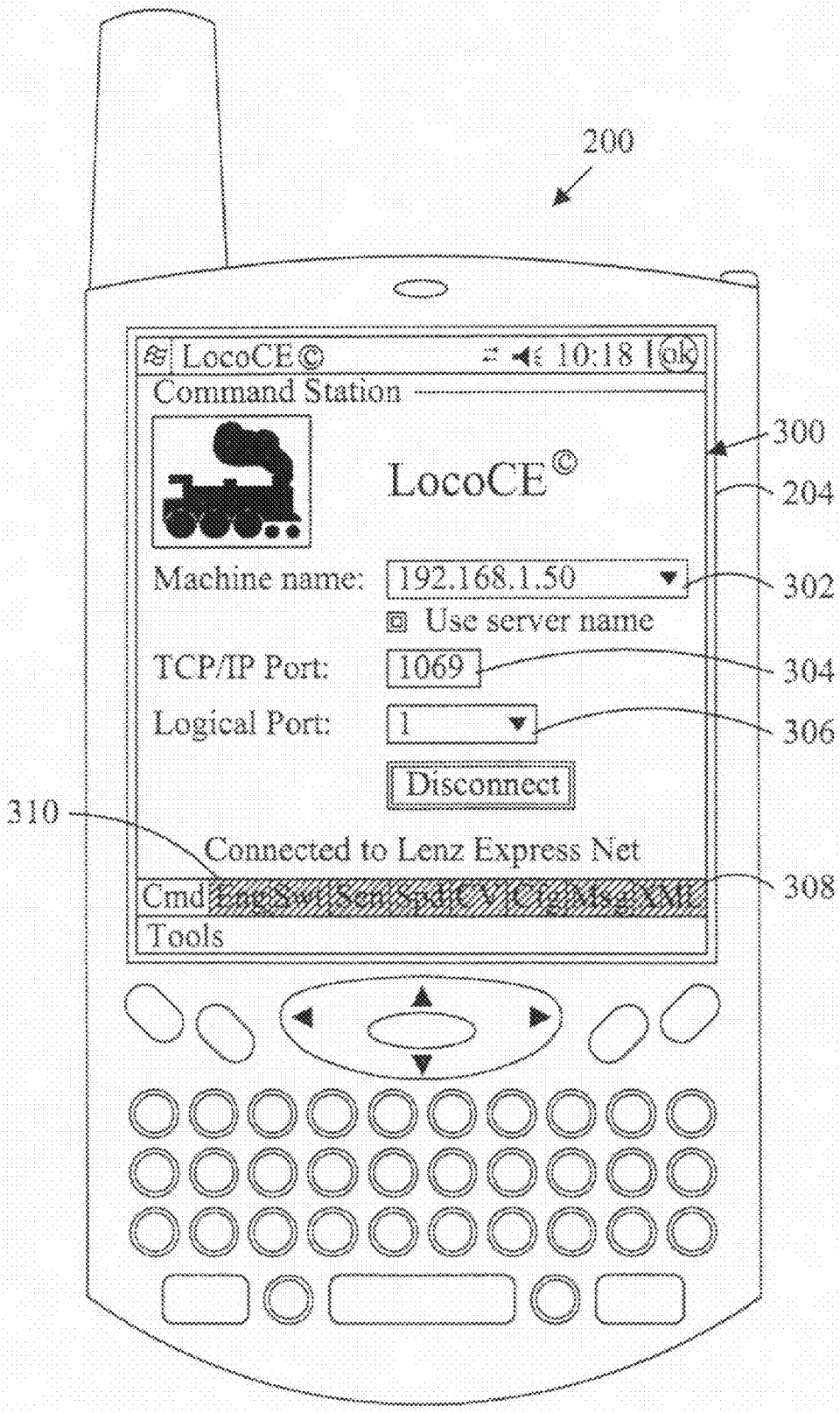
FIG. 5 is pictorial representation of a main screen for the DCC model railroad throttle.
Figure 6:
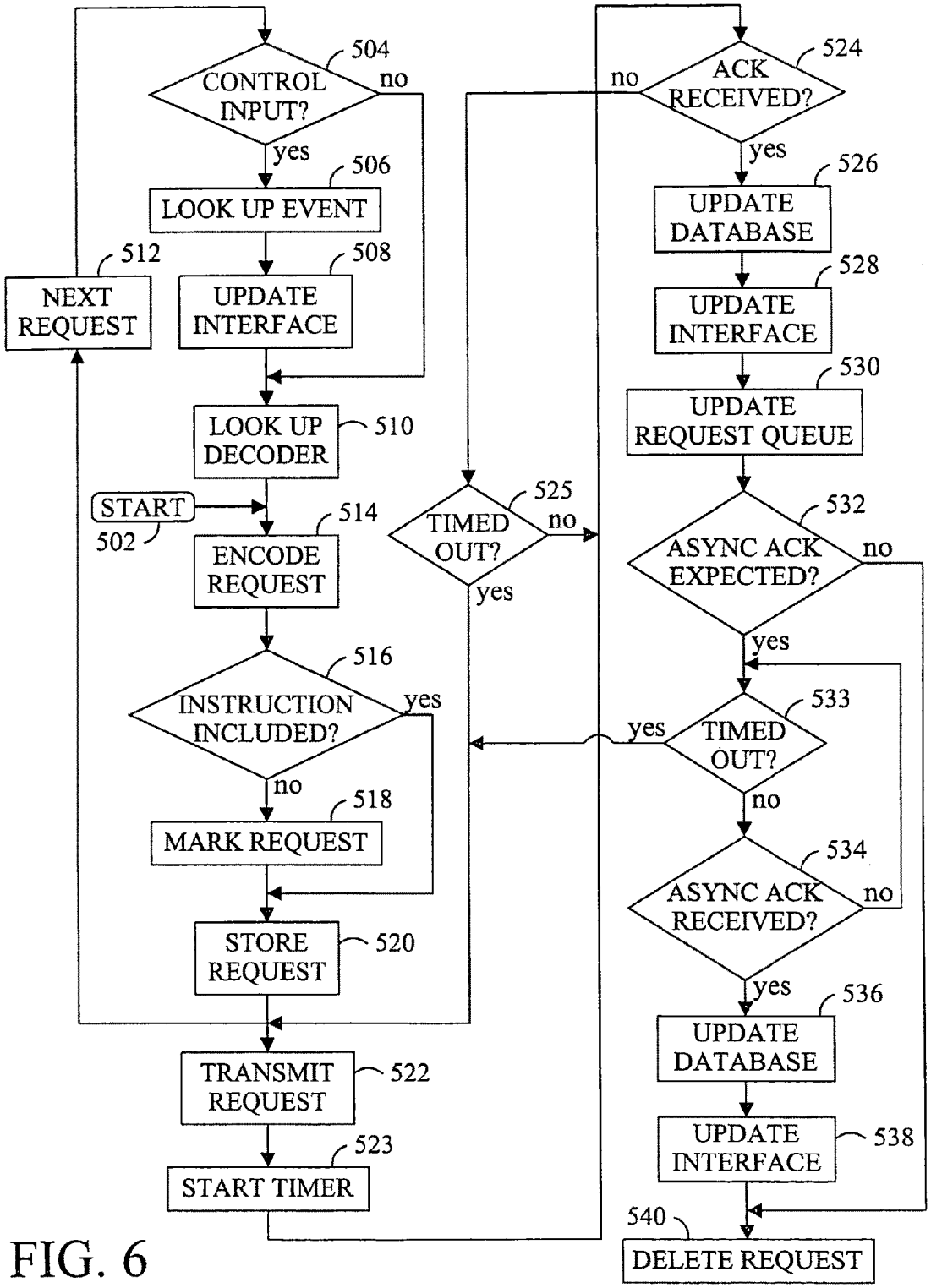
FIG. 6 is a flow diagram for the DCC model railroad throttle.

Referring to FIG. 5, when the user initiates the throttle from the start menu of the portable data processing system 200, the throttle program 250 exhibits a main screen GUI 300 on the display 204. The main screen GUI 300 identifies the physical TCP/IP address 302 of the network on which a layout controlling interface 102 is being operated and which is connected to the throttle by a communications transport 108. The main screen 302 also identifies the TCP/IP port number 304 and the logical port 306 of the connection and includes a menu 308 that permits the user to select the ones of the plurality of GUIs making up the throttle 104. Referring to FIGS. 6 and 14, when the throttle 104 connects 502 to the layout controlling interface 100, the throttle encodes 514 a request 600 (identified by a bracket) to the layout controlling interface indicating the logical port 602 connected to a command station of the layout. If the logical port is connected to a command station, the layout controlling interface 102 responds 610 indicating the characteristics of the command station, for example a simulation command station named "KAM" 612.

When the throttle 104 has connected to the layout controlling interface 102, the throttle requests the addresses of each of the decoders in use in the layout. Referring to FIG. 15, a request assembler 258 prepares a series of requests, such as the exemplary request 630 (indicated by a bracket) requesting the identify of the decoders from each class that are included in the layout. The exemplary request 630 requests the identity of the decoders of the engine (eng) class. Similar requests would be used of obtain the identities of the switch and sensor decoders included in the layout. The layout controlling interface 102 responds, as exemplified by response 640 (indicated by a bracket) with the identities, including the addresses 642 and linear addresses 644, of each of the decoder included in the class. The throttle program 250 includes a throttle database 252 comprising the identities and respective status of the various decoders included in the layout. When the layout controlling interface responds 524, the throttle updates the throttle database 526 to reflect the current makeup of the layout and the throttle is ready to operate the devices included in the layout. Automatically updating the throttle database 252 when the throttle 104 is initiated minimizes the delay and effort required to begin operating the controlled devices of the layout, increasing the satisfaction of the user with the model train experience.

Figure 7:
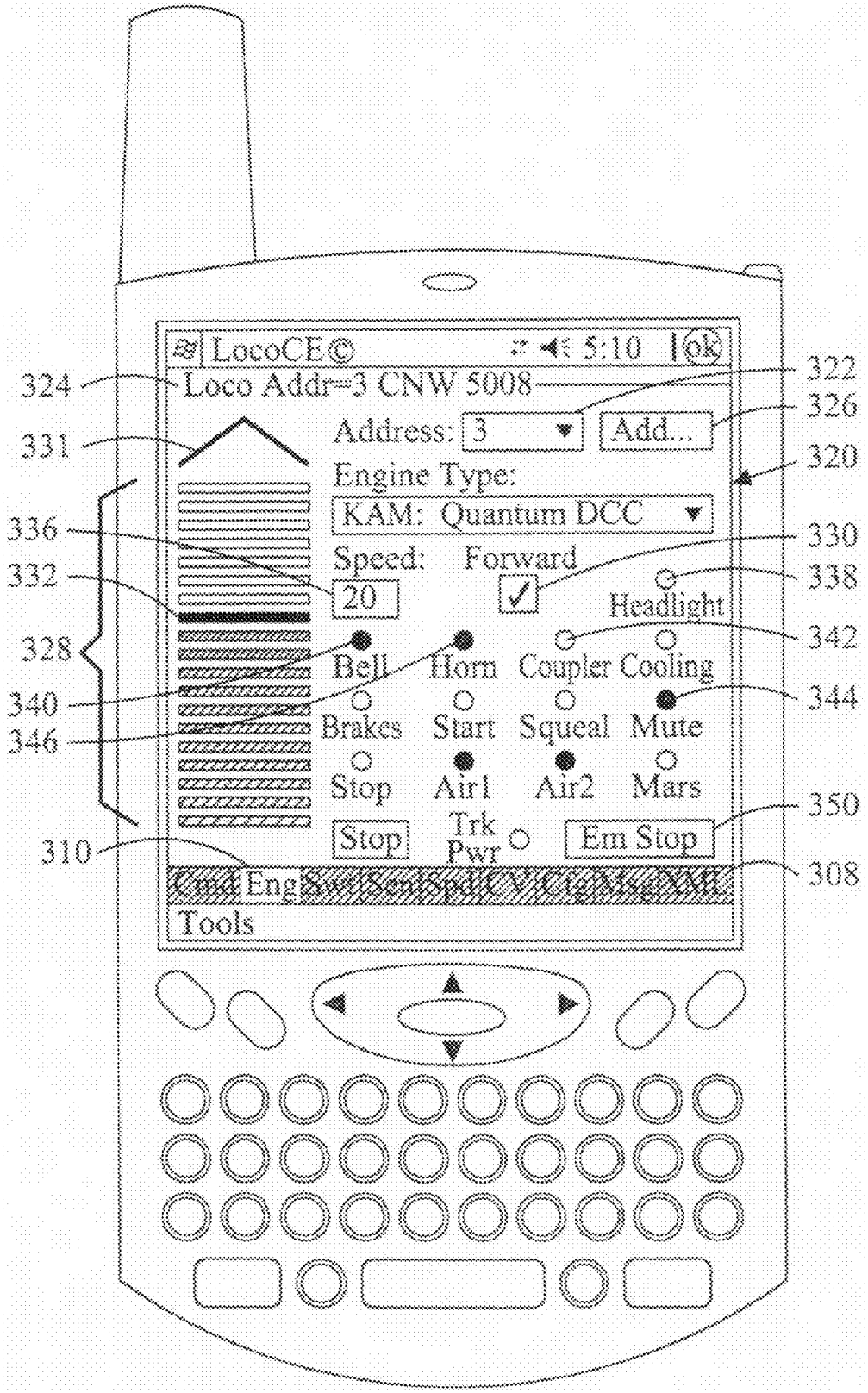
FIG. 7 is a locomotive control graphical user interface for the DCC model railroad throttle.
Figure 8:
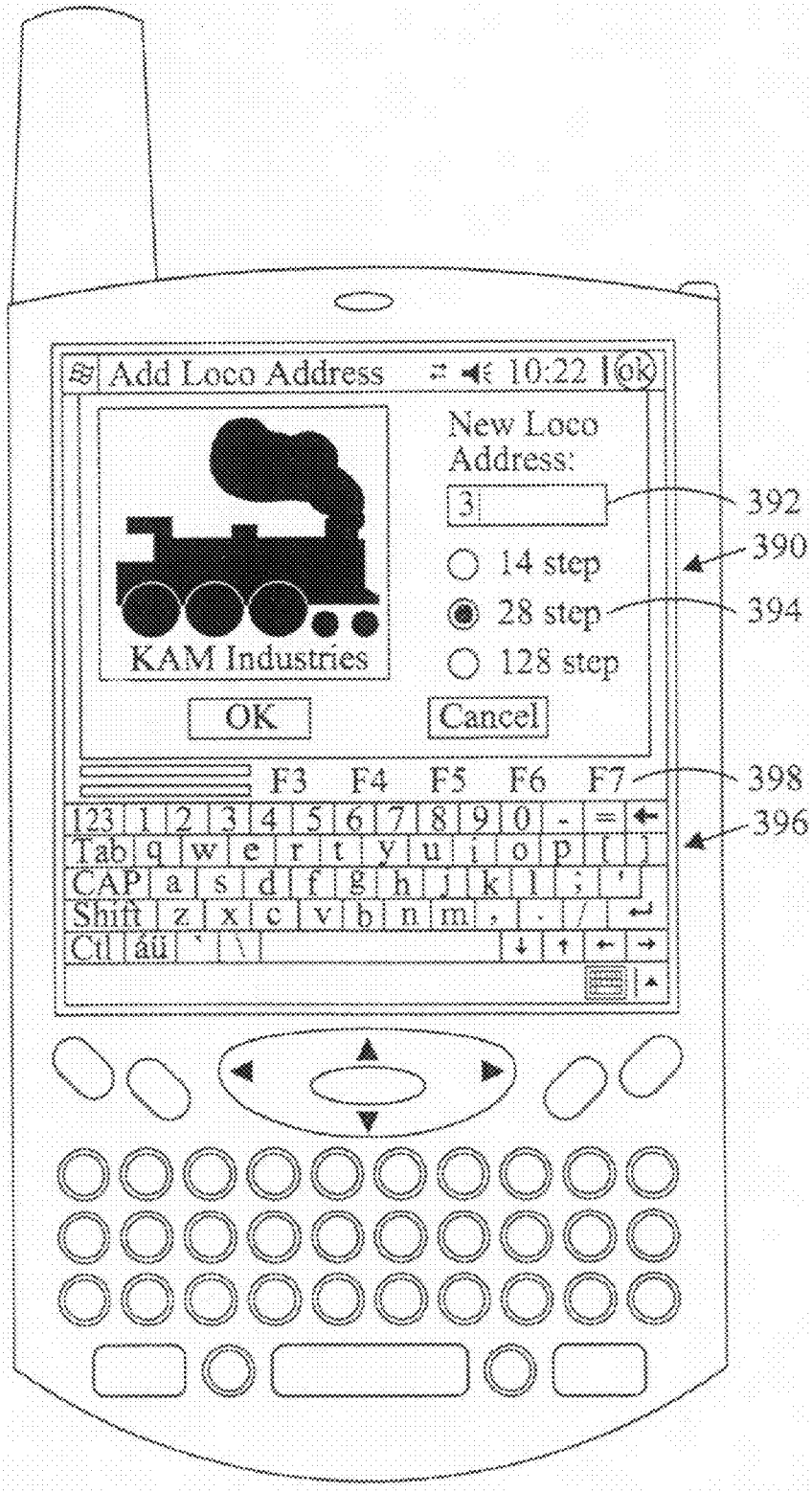
FIG. 8 is a graphical user interface for adding a locomotive to the DCC model railroad throttle.

For example, to begin operating a locomotive the user selects ENG 310 in the menu 308 causing a locomotive operating GUI 320 to be displayed as illustrated in FIG. 7. The locomotive operating GUI 320 includes virtual instrumentation and user operable controls for monitoring and operating a locomotive. The locomotive operating GUI 320 includes a drop down menu 322 permitting selection of an address 322 of a locomotive to be controlled by the throttle and a display 324 indicating the address, type, and identification of the particular locomotive that is currently operable by the throttle. The throttle database 252 can contain the addresses and status of up to 65,000 decoders for locomotives, switches and sensors that can be operated from the throttle's operator interfaces.

The locomotive operating GUI 320 also includes instrumentation and controls for the speed 328 (indicated by a bracket) and direction 330, 331 of the locomotive. The locomotive's direction of travel can be changed by contacting the direction control 334 or the travel direction graphical display 331 with a stylus causing the travel direction to toggle from forward to reverse or vice versa and causing the travel direction graphical display 331 and the textual indication of traffic 334 to toggle with the command to change direction. The user can change the speed of the locomotive by contacting the tactile display 204 with a stylus at one of the bars, for example bar 332, of the locomotive speed control graphic display 328. When a bar 332 of the speed graphic 328 is selected, its color or shade changes to indicate the speed selected by the user. A numerical display 336 also displays a numerical indication of the speed step selected for the locomotive. The locomotive operating GUI 320 includes a plurality of other user operable controls for features and accessories of the train, such as the headlight 338, bell 340, horn 346, coupler 342, and sound effects 344. By actuating appropriate controls with a stylus, the train can be stopped normally 348 or at an emergency rate 350.

A new locomotive may be added to the layout by making tactile contact with the add button 326 of the locomotive operating GUI 320. The throttle program 250 causes exhibition of a locomotive address addition GUI 390 that includes a drop down menu 392 permitting selection of the new locomotive's address. Tactile contact with the locomotive address addition GUI 390 enables identification of the number of speed steps available from the locomotive's decoder 394. From a tactile, virtual keyboard 396 the user can program the functions actuated by button controls 398 that will be displayed on the locomotive operating GUI 390.

Figure 9:
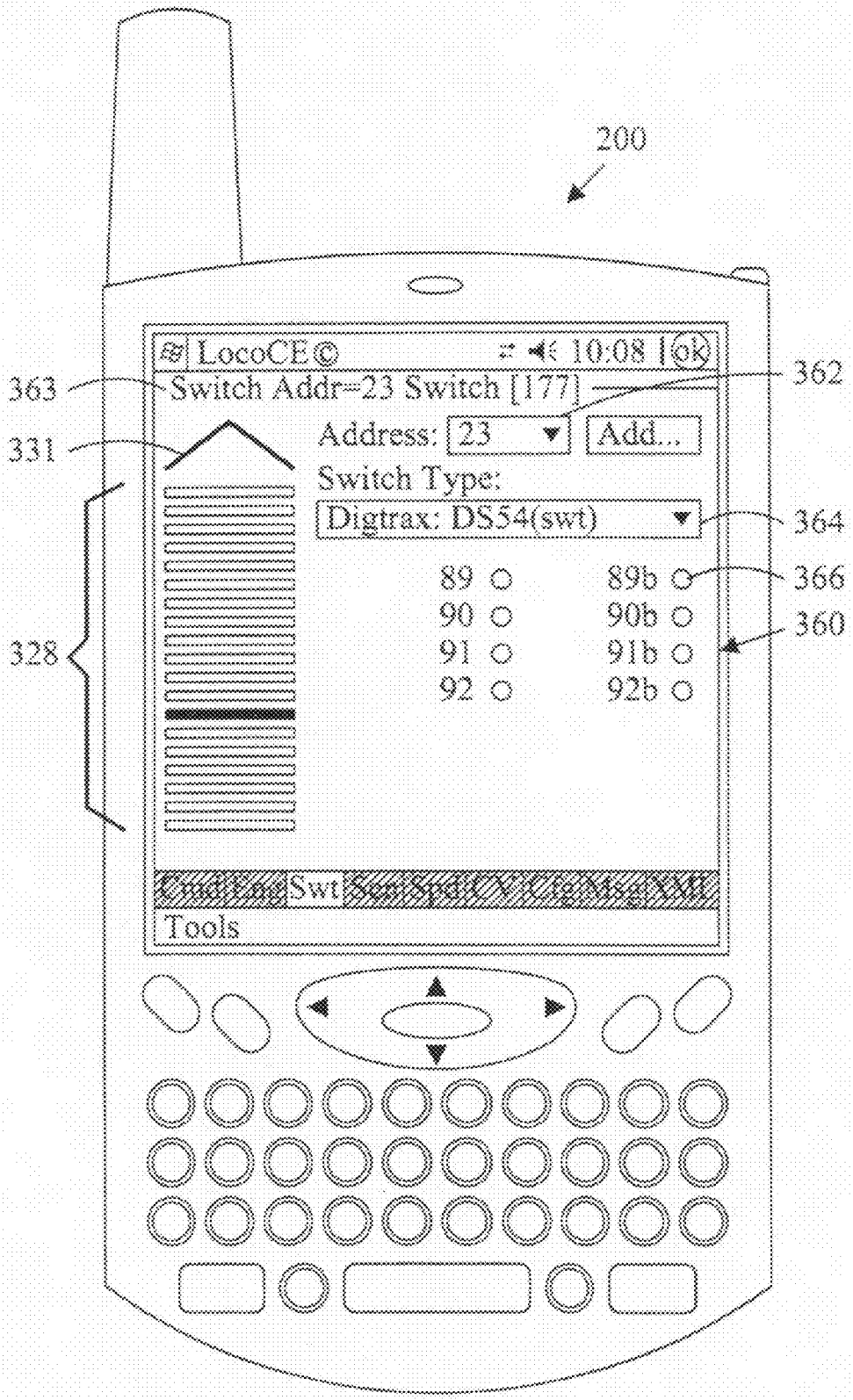
FIG. 9 is a track switch control graphical user interface for the DCC model railroad throttle.
Figure 10:
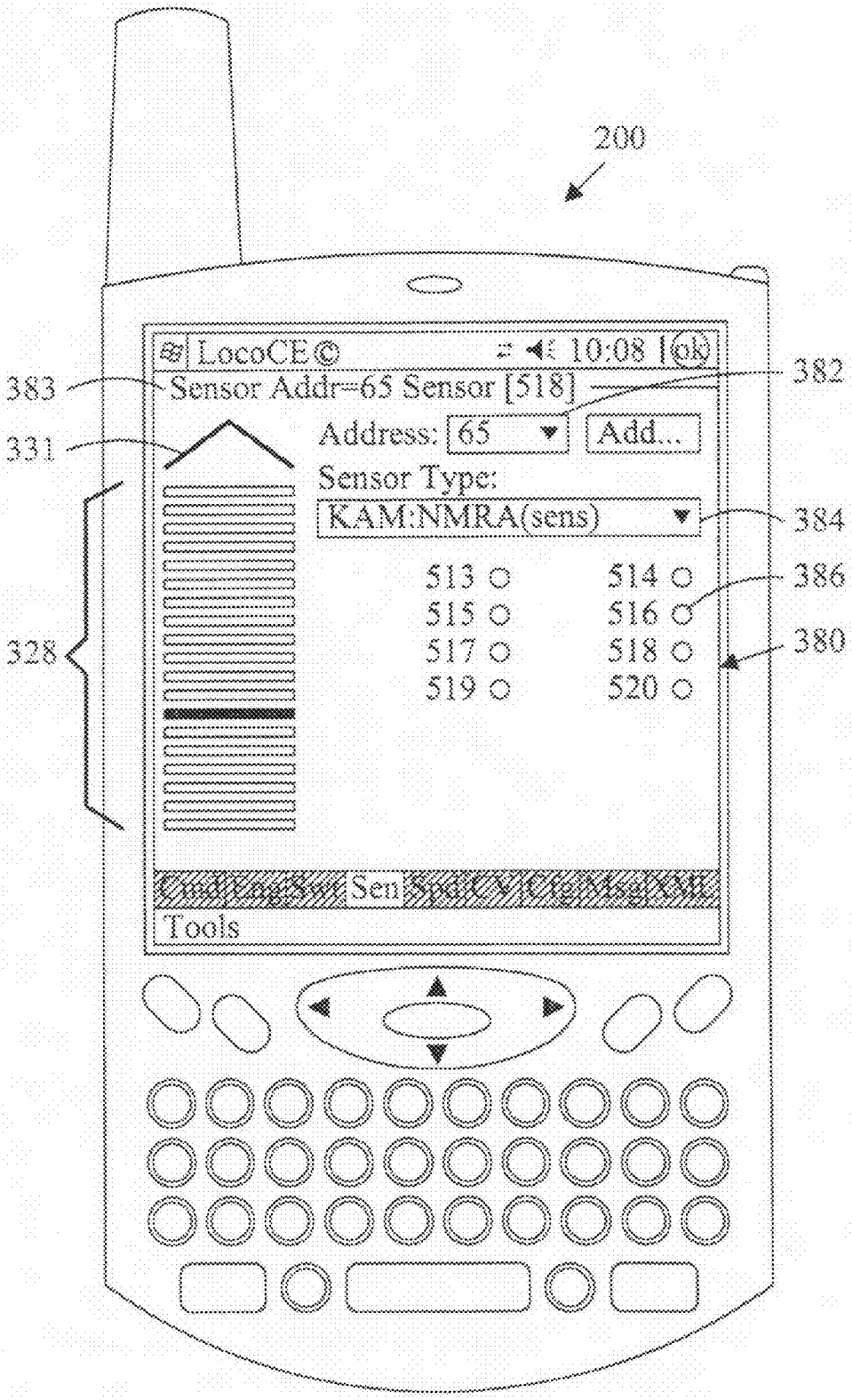
FIG. 10 is a sensor control graphical user interface for the DCC model railroad throttle.

Referring to FIGS. 9 and 10, from the menu 308 the user can elect to display GUIs enabling control of track switches 360 or turnouts and sensors 380 that provide information about conditions existing in the layout. By contacting the tactile display 204 with a stylus at an appropriate function button, for examples button (89*b*) 366, or button (516) 386, the user can cause the turnout controlled by the button to be toggled or the sensor controlled by the button to be read by the digital control station 104. While selecting switches and sensors, the user can continue to control the speed and direction the locomotive through tactile contact with the speed 328 and direction 331 graphical controls that are displayed on the switch 360 and sensor 380 GUIs with the switch and sensor controls. The switch 360 and sensor 390 GUIs also include menus permitting the user to select the address 362, 382 and the corresponding type of switch 364 or sensor 394 of a switch or sensor to be added to the database of decoders included in the layout.

Figure 11:
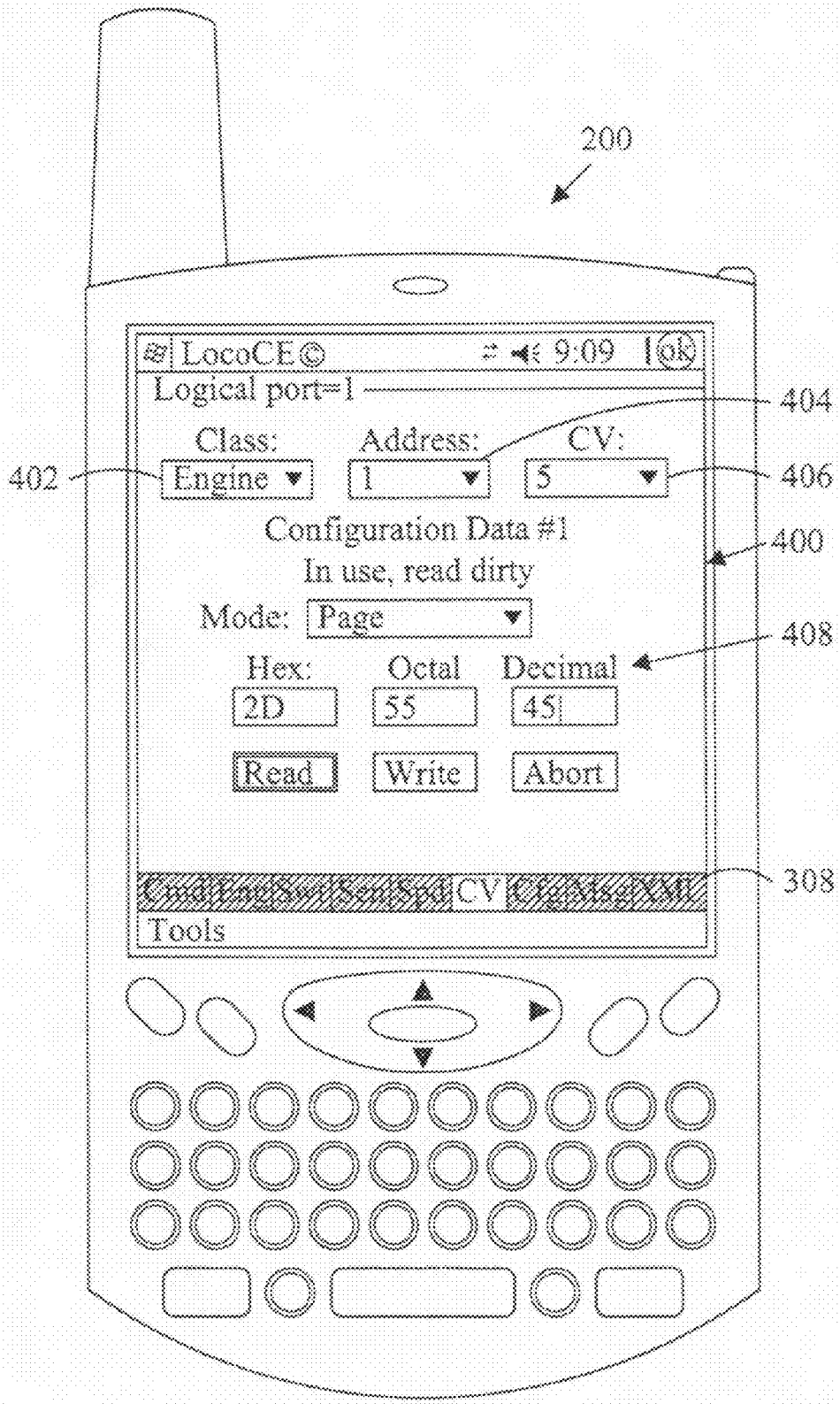
FIG. 11 is a configuration variable programming graphical user interface for the DCC model railroad throttle.
Figure 12:
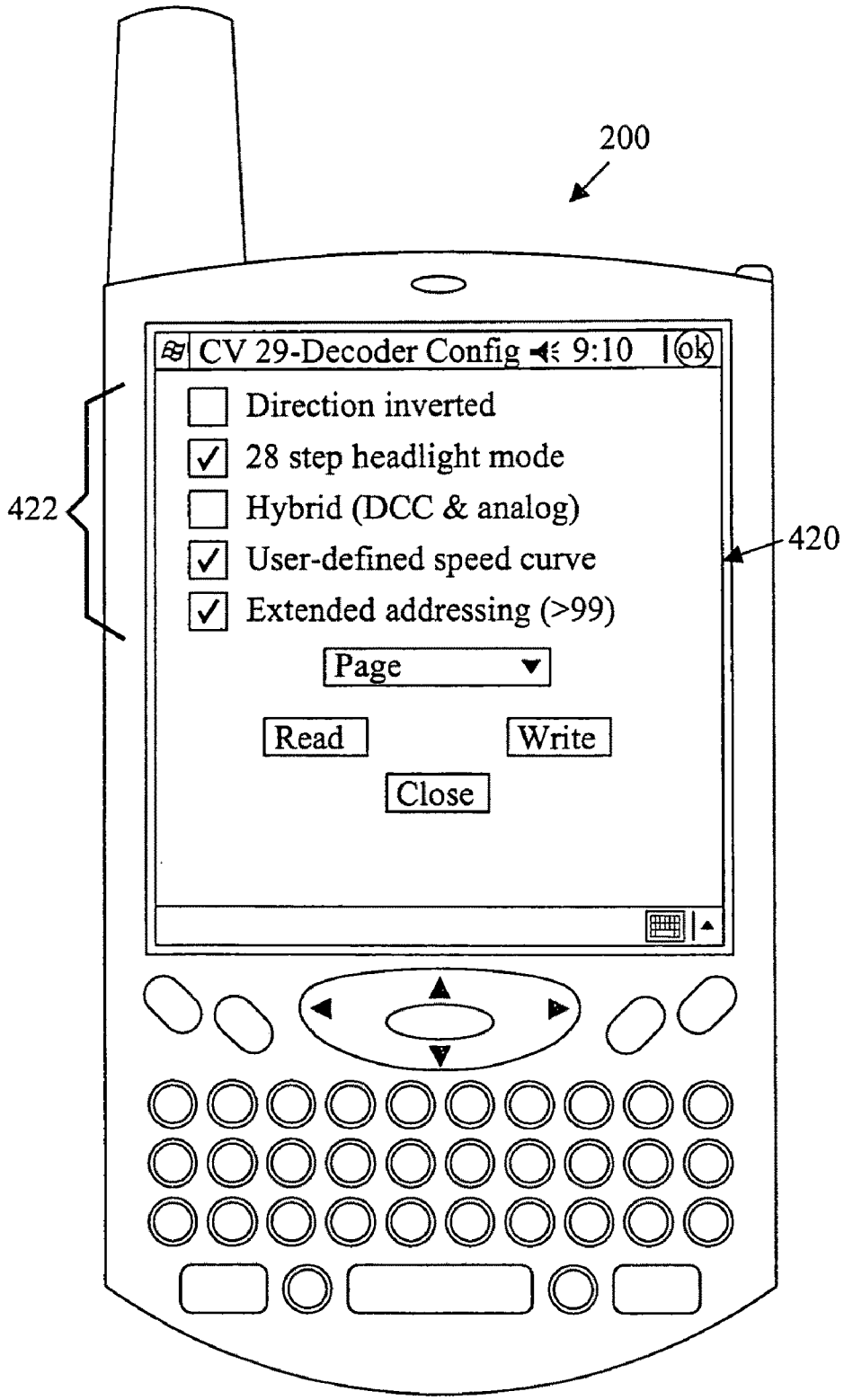
FIG. 12 is a CV 29 programming graphical user interface for the DCC model railroad throttle.

Referring to FIGS. 11 and 12, the user can also program the layout's decoders from the throttle's user interface. From the menu 308, the user can select a CV programming GUI 400 enabling the user can change the values stored in the plurality of registers comprising a decoder. These values, known as configuration variables or CVs define the decoder's address and, in many cases, the response of the controlled device to an instruction from the digital command station. A locomotive decoder may include 106 or more CVs each defined by a binary number. From the CV programming GUI 400 the user can select the class (engine, switch, or sensor) of the decoder 402, the address of the decoder 404 and the specific CV to be programmed 306. The specific binary value to be inserted in a particular CV can be specified by the user in hexadecimal, octal, or decimal form 408. Since the current state of the CVs of each decoder is downloaded from the controlling interface and maintained in the throttle database 252, only CVs requiring modification need be programmed through the CV programming GUI reducing the time required for programming.

A number of optional features of a locomotive can be selected by entering the proper value in CV 29 of the decoder. A CV 29 programming GUI 420, as illustrated in FIG. 12, enables the user to program CV 29 by selecting desired features, such as inverted travel direction and hybrid DCC and analog operation, and making tactile contact with the appropriate feature controls 422 (indicated by a bracket).

Figure 13:
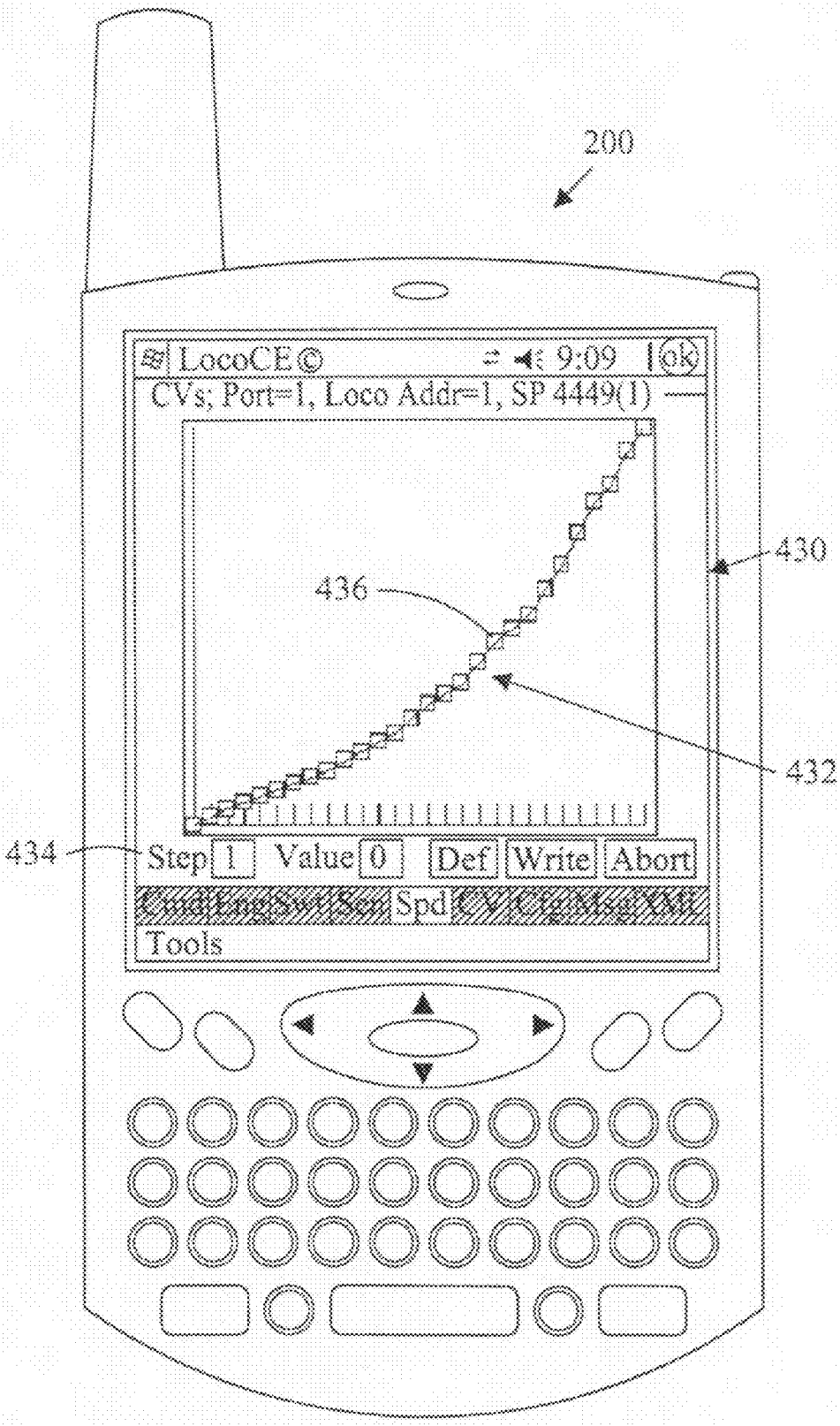
FIG. 13 is a locomotive speed curve programming graphical user interface for the DCC model railroad throttle.

The user can also change the speed-speed step curve of the locomotive by changing the values of the respective speed steps programmed into the decoder. Changing speed curve permits the user to customize the acceleration of the model train to more realistically represent that of a prototype train with its momentum. In response to selection in the menu 308, the throttle 104 will displays a speed programming GUI 430 as illustrated in FIG. 13. The speed programming GUI 430 graphically 432 and numerically 434 represents the values of each of the 14, 28, or 128 speed steps that can be output by an appropriate DCC decoder. The user can change the shape of the speed curve 432 by making tactile contract with one of the speed steps on the graphically display, for example step 436, and virtually moving the graphical representation of a speed step up or down.

While the exemplary user interface provides virtual operating and programming controls for the locomotives and accessories of the layout that are displayable on the display of the data processing device, one or more controls for operating or programming the decoders of the layout could be provided through other user input devices commonly included in portable data processing devices, such as the navigation button 212, the function keys 30 or the keys of the keyboard 206.

The throttle 104 encodes and transmits requests inquiring of or directing a change in the status of the decoders included in the layout and receives acknowledgments enabling updating of the throttle database 252 and the user interface. For example, referring to FIG. 6, after the throttle is initiated 502; the request assembler 258 encodes a request 630 to the layout controlling interface 102 for the identities and statuses of the various engine decoders making up the layout. The request assembler 258 encodes the request according the specifications of the communications transport 108, 110 that is in use by the data processing device 200 to connect the throttle 104 and the layout controlling interface. For example, the request assembler 258 may generate a request in the extensible markup language (XML) for transmission over a personal area network 60 utilizing the TCP/IP protocol. A communications manager 260 causes the request to be transmitted to the layout controlling interface 102 by enabling a communications facility, such as the wireless transceiver 232 and data transfer routines 272 of the portable data processing system. The communications manager 260 receives at least one acknowledgement of the request from the layout controlling interface. In the case of the request 630 following initiation of the throttle program 250, the layout controlling interface 102 acknowledges the request 640 with the current identities of the decoders and permitting the throttle data base 252 to be updated to reflect the current makeup of the layout. The throttle 104 is now ready to accept user inputs for operating the trains and accessories of the layout.

When the central processor 236 detects a user input to a control, such as the speed control 328 of the locomotive operating GUI 320, a layout manager 256 of the throttle program 250 identifies the input by determining, for example, the location of a stylus contact with the tactile display 204. The layout manager 256 identifies an event corresponding to the user input from the throttle database 252. For example, if the user contacts the tactile display with the stylus at one of the bars 332 of the locomotive speed graphic 328, the CPU 226 determines the location of the contact with the tactile display. The layout manager 256 identifies the event that is to occur as a result of contact at that location on the exhibited GUI of the user interface 254, for example, the locomotive is to be instructed to operate at a particular speed setting. If required by the event, the layout manager 256 causes the GUI to be updated 508. By way of examples, a pushbutton displayed on the GUI may be momentarily virtually depressed and then released or a color or shade of a selected bar 332 of the locomotive speed graphic 328 may be changed to inform the user that the interface has recognized the user's input.

From the throttle database 252 the request assembler 258 determines the identity of the decoder that is operable by the identified control 510. For example, the particular decoder that is currently operable by the controls of the locomotive operating GUI 320 is identified 324 on the displayed user interface. Referring to FIG. 16, the request assembler 258 encodes a request 450 (indicated by a bracket) including a port 452 and an address 454 of the currently operable decoder. In the event of a request seeking information related to the status of a decoder, the request assembler 252 will determine the identity of the decoder and encode a request containing only the port and address of the decoder that is the subject of the query. If the request relates to a command, for example, a command to operate a locomotive at a particular speed and in a particular direction, the request assembler 258 will also encode the instruction for the decoder 458 (indicated by a bracket), for example, an instruction to operate the locomotive in the forward direction at the speed step corresponding to the bar of the locomotive speed control graphic 328 designated by the user input.

The request assembler 258 registers an identity of the request 520 in a request queue 262. The request assembler 258 also determines whether the request includes an instruction to a decoder. If the request does not include an instruction, the request will be acknowledged only once when the status data for the decoder is returned. However, if the request includes an instruction, the layout controlling interface 102 will acknowledge the request before execution and again, asynchronously, following its execution. To determine when it is appropriate to delist a request registered in the request queue 262, the absence of an instruction in the request is registered in conjunction with the request identity 518. For example, the request queue 262 may comprise a plurality of registers for storing the port and address identifying a request and registers to be toggled upon receipt of the first and second acknowledgements from the layout controlling interface. If the request does not include an instruction, the register for the second acknowledgement can be toggled when the request is registered marking the request for delisting upon receipt of the first acknowledgement by the layout controlling interface 102. The throttle is ready to encode the next request 512 and the communications manager 260 causes transmission of the request 522 to the layout controlling interface 102 over the communications transport 108, for example, by energizing the RF wireless port 234 of the portable data processing device 200.

Requests to the controlling interface 102 from the throttle 104, or another client program 106, are received by a request parsing facility that is appropriate to the specifications of the particular communications transport 108, 110 connecting the respective client program and the layout controlling interface. The request parsing facility comprises a request processor 112 that parses the request and queries a local database storage 114 to determine if it is necessary to package a command to be transmitted to a command queue 104. The local database 114 primarily contains the configuration of the model railroad layout and the state of the devices included in the layout, such as, the speed of a train, the direction of a train, whether a draw bridge is up or down, whether a light is turned on or off. Referring to FIG. 14, if the request received by the request processor 112 includes only a port 452 and an address 454 the request is treated as a query about the state of the decoder. The request processor 112 retrieves the appropriate information from the local database storage 114 and provides the information to a response processor 118. The response processor 118 then provides a response to the throttle 104 indicating the state of the device and releases the communications transport 108 for another transmission.

Using the configuration information in the local database storage 114, the request processor 112 also verifies that the request received is a potentially valid operation. If the request is invalid, the request processor 112 provides such information to the response processor 118, which in turn returns an error indication to the throttle 104.

The request processor 112 may determine that the local database storage 114 does not contain the information necessary to provide a response to the throttle 104 concerning the state of a device or the validity of a request. In either case, the valid unknown state or action request is packaged and a command is forwarded to a command queue 116. If necessary, the packaging of the command may add information from the local database storage 114 to complete the request from the throttle 104. Referring to FIG. 15, together with packaging the command for the command queue 116, the request processor 112 commands the response processor 118 to provide a response 460 to the client programs 104, 106 acknowledging the event, even though the event has yet to actually occur on the layout. The acknowledgment 460 responding to the throttle 104 frees the communications transport 108 to convey additional transmissions and reduces user frustration with the relatively slow response of the layout to DCC commands by providing a nearly instantaneous response to the user's input to the client program.

When the request is processed by the layout controlling interface 102, the response processor 118 is directed provide an acknowledgement of the request to the throttle 104 and other client programs 106 even though the event has yet to actually occur on the layout. The acknowledgement responding to a query request may include data indicating the state of a controlled device. An acknowledgment may also include an error message indicating the request is invalid or may indicate that a command corresponding to the request has been processed. When the acknowledgement is received 524 by the communications manager 260, the throttle database 252 is updated 526. As required, the user interface is also updated 528. For example, the color or shade of a selected bar of the speed control graphic 328 on the locomotive operating GUI 320 may be changed indicating that the layout controlling interface has received the request.

In addition, the request queue 262 is updated when the acknowledgment is received from the layout controlling interface 530. If an asynchronous response to the request is not anticipated 532, updating the request queue 262 to indicate receipt of the acknowledgement from the layout controlling interface 102 delists the request identification in the request queue 540. However, if the an asynchronous response is expected 532, the request identification remains in the request queue.

Each command in the command queue 116 is fetched by a command processor 120 and processed. The command processor 120 queries a controller database storage 122 for additional information, as necessary, and determines if the command has already been executed based on the state of the devices in the controller database storage 122. In the event that the command has already been executed, as indicated by the controller database storage 122, the command processor 120 passes information to the command queue 116 indicating the state of the device that is the subject of the command or that the command has been executed. The response processor 118 fetches the information from the command queue 116 and provides a suitable response to the client programs 104, 106, if necessary, and updates the local database storage 114 to reflect the updated status of the controlled devices of the layout.

If the command fetched by the command processor 120 from the command queue 116 requires execution by a controlled device, such as a locomotive decoder, then the command is posted to one of several external device control logic blocks 124. The external device control logic block 124 processes the command from the command processor 120 and issues appropriate control commands to a digital command station 108 that encodes and transmits DCC digital commands to the decoders of the controlled devices. There are several different manufacturers of digital command stations, each of which has a different set of input commands. Providing a plurality of external device control logic blocks 124, each designed to interface with a particular digital command station, permits a number of differing digital command stations to be used with a layout.

The digital command station(s) 108 provide a response to the external device control logic block 124 which is checked for validity and identified with the corresponding prior command so that the controller database 122 may be updated. The command processor 120 is notified of the results from the external control logic block 124 and, if appropriate, forwards the results to the command queue 104. The response processor 118 clears the results from the command queue 116 and updates the local database 102. Referring to FIG. 16, the response processor also sends an asynchronous response 480 to the client programs 104, 110, if appropriate. The asynchronous response 480 updates the client program to the actual state of the layout devices, if changed, and provides an error message to the client program 104, 110 if the device's actual state was previously improperly reported or a command did not execute properly.

When the asynchronous response 480 is received, the CPU updates the throttle database 536 and the user interface 538 as required. For example, the locomotive speed graphic 328 may be updated by changing the color or shade of one or more bars to cause the graphic to indicate the speed step at which the locomotive is actually operating. When the second, asynchronous response 480 locofeedback) is received by the throttle 104, the request queue 262 is also updated 540. Since the request queue 262 indicates that both expected responses from the layout controlling interface 102 have now been received, the request identification is removed from the request queue 540.

The throttle of the model train control system provides a convenient user interface that can be used with little set up time and effort and permits the operator of the model train layout to operate the layout from advantageous positions adjacent or remote from the layout for a satisfying user experience.

The detailed description, above, sets forth numerous specific details to provide a thorough understanding of the present invention. However, those skilled in the art will appreciate that the present invention may be practiced without these specific details. In other instances, well known methods, procedures, components, and circuitry have not been described in detail to avoid obscuring the present invention.

All the references cited herein are incorporated by reference.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

The invention claimed is:

1. A throttle for operating a digitally controlled model railroad layout, said throttle comprising:

(a) a request assembler to encode a request including an identity of a digitally controlled device included in said model railroad layout and to indicate if an operating instruction to said device is encoded in said request;

(b) a communication manager to transmit said request to a layout controlling interface arranged to communicate a digital instruction to said digitally controlled device and to receive an acknowledgement of said request from said layout controlling interface; and (c) a request queue registering said request, delisting said request in response to a first acknowledgement of said request from said layout controlling interface if said request includes an instruction to said digitally controlled device and otherwise delisting said request in response to receipt of a second acknowledgment of said request.

2. The throttle for operating a digitally controlled model railroad layout of claim 1 further comprising:

(a) a user interface including at least one user operable control; and (b) a layout manger to:

(i) detect a user input to a user operable control;

(ii) identify an event corresponding to said detected user input;

(iii) identify a digitally controlled device included in said model railroad layout and operably responsive to said user input; and (iv) communicate said event to said request assembler for encoding with said identity of said digitally controlled device operably responsive to said user input.

3. The throttle for operating a digitally controlled model railroad layout of claim 2 further comprising a throttle database including an identity and a configuration state of a digitally controlled device included in said model railroad layout.

4. The throttle for operating a digitally controlled model railroad layout of claim 2 further comprising a throttle database including an identity of an event corresponding to a user operable control of said user interface.

* * * * *